United States Patent [19]

Hayday

[11] Patent Number: 4,667,659

[45] Date of Patent: May 26, 1987

[54] MASSAGING DEVICE FOR MASSAGING SKIN INSIDE A CAST, SPLINT OR THE LIKE

[76] Inventor: Barbara E. Hayday, 917 Grenoble Blvd., Pickering, Ontario, Canada, L1W 1T9

[21] Appl. No.: 823,574

[22] Filed: Jan. 29, 1986

Related U.S. Application Data

[63] Continuation-in-part of Ser. No. 534,606, Sep. 22, 1983, abandoned.

[30] Foreign Application Priority Data

Jun. 29, 1983 [CA] Canada ..... 431404

[51] Int. Cl.[4] ..... A61H 7/00

[52] U.S. Cl. ..... 128/62 R; 123/63; 123/67

[58] Field of Search ..... 128/62 R, 67, 63

[56] References Cited

U.S. PATENT DOCUMENTS

| | | | |
|---|---|---|---|
| 799,895 | 9/1905 | Doughty et al. | 128/62 R |
| 998,328 | 7/1911 | Czinjak | 128/62 R |
| 1,817,585 | 8/1931 | Samuel | 128/62 R |
| 1,885,572 | 11/1932 | Wood | 128/62 R |
| 1,965,861 | 7/1934 | Schneider | 128/61 |
| 2,154,831 | 4/1939 | Booharin | 128/63 |
| 3,912,667 | 10/1975 | Spitzer et al. | 604/366 |
| 3,959,891 | 6/1976 | Horne | 128/67 |
| 4,091,491 | 5/1978 | Hoffman | 128/62 R |
| 4,249,521 | 2/1981 | Gueret | 128/62 R |
| 4,505,271 | 3/1985 | Weber | 128/402 |

FOREIGN PATENT DOCUMENTS

| | | | |
|---|---|---|---|
| 799123 | 6/1936 | France | 128/63 |
| 1200089 | 6/1959 | France | 128/67 |
| 2285114 | 4/1976 | France | 128/63 |
| 1981 | of 1889 | United Kingdom | 128/62 R |
| 1230364 | 4/1971 | United Kingdom | 128/62 R |

*Primary Examiner*—Edgar S. Burr
*Assistant Examiner*—Tonya Lamb
*Attorney, Agent, or Firm*—Riches, McKenzie & Herbert

[57] ABSTRACT

This invention relates to a medical device and more particularly, to a novel medical device suitable for use as a skin massager to relieve itchiness, irritation and general discomfort of the skin felt by a person wearing a cast or splint. The device comprises a thin, elongated strip having a plurality of randomly-spaced protrusions on one surface and a plurality of rounded indentations inset in the opposite surface, with the remaining areas of the opposite surface being smooth. The device provides a safe yet economical manner to massage the skin without producing any untoward or allergic reactions and is quite inexpensive to produce.

3 Claims, 3 Drawing Figures

MASSAGING DEVICE FOR MASSAGING SKIN INSIDE A CAST, SPLINT OR THE LIKE

BACKGROUND OF THE INVENTION

Cross Reference to Related Applications

This application is a continuation-in-part application of U.S. patent application Ser. No. 534,606 filed Sept. 22, 1983 now abandoned May 29, 1986.

1. Field of the Invention

This invention relates generally to medical devices and more particularly to a novel medical device suitable for use as a skin massager and specifically, for relieving itchiness, irritation and general discomfort of the skin often felt by a person whose skin is enclosed in a cast, splint or similar bandage.

2. Description of the Prior Art

The use of casts, splints or similar bandages is quite old in the medical field and they are used primarily to immobilize a part of the body such as an arm, leg etc. The commonly accepted method of applying a cast involves first shaving the skin, surrounding the part of the body to be immobilized with a stockinette mesh (which is available as a tube of any number of sizes), then a padding material such as cotton wool and finally applying the cast material which is usually plaster of Paris or fibre glass. This material is soaked briefly in lukewarm water, lightly compressed, and then rolled on top of the padding material, then smoothed and allowed to set.

Different types of casts are used for different parts of the body and in some cases, poles, struts or other strengtheners may be inserted into the case to strengthen or to create angular displacements as desired. The cast or splint must be snug to the immobilized area but there must be sufficient room to allow for some flexing of muscles of the immobilized area.

Thus, when a cast is made, a natural space will occur between the stockinette and the skin. This space allows the skin to breathe, allows any moisture to dry out, allows for the dissipation of heat, increases the circulation in the immobilized area, and helps to prevent or reduce nerve damage of the skin. Also, the immobilized area may well swell a little so that room is required for this expansion.

Once the cast or splint is applied to the body, the skin of the enclosed area cannot "breathe" as does normal skin. Thus, it may become very itchy and the person whose limb is enclosed, is very uncomfortable due to this itchiness. The skin will also sweat more than if it were not enclosed as the heat produced by the skin is not easily dissipated. Also, normal skin desquamation cannot occur so that a build up of the epidermal layer occurs which adds to the discomfort of the wearer of the cast.

It is thought that the itchiness is created by a combination of the movement of dry skin scales which are created by desquamation and the collection of debris inside the cast. The debris is partly composed of the cast itself which gradually crumbles and produces dust as well as debris and dirt which collects inside the cast.

In order to relieve such feelings, most persons are told by the physician not to do anything and to suffer these feelings. It is possible to force air into a cast to try to remove some of the debris. In *Orthopaedic Nursing Procedures,* 2nd Edition, by Kerr, A., (Springer Publishing Company, Inc., New York, N.Y.), it is recognized that itching inside a cast is a common complaint but the author recommends not to use any sharp object or stick to relieve such itching. It is recommended to insert a strip of gauze in body casts, to use wire coat-hangers or to use vacuum cleaners to blow out any foreign bodies inside the cast.

In the past, some devices have been proposed to relive skin itchiness and general discomfort. However, none of these devices have been specifically designed nor are they applicable to relieve discomfort for those persons wearing casts, splints and the like. These devices have been proposed as general skin massaging devices and are not, for the most part, suitable to relieve such discomfort from the wearing of the cast.

None of these devices are of a simple inexpensive yet safe construction. One of the earliest of such devices is shown in U.S. Pat. No. 998,328 granted to Czinjah which discloses a device referred to as a massaging implement which increases the circulation and removes any impurities from the pores of the skin. A handle is located at an end of a rod with a split sleeve mounted on the opposite end. An arm is mounted on a sleeve and branches are attached to the offset portion. Then bumps or projections were provided as the rough surface for rubbing the skin.

Various forms of belts such as those disclosed in U.S. Pat. No. 1,812,891 granted to Meehan and such as those disclosed in U.S. Pat. No. 2,015,255 granted to Charpies et al have been disclosed although they do not fulfill certain expressed needs as set forth hereinafter.

More recently, massaging devices have been prepared and reference is made to U.S. Pat. No. 2,807,815 granted to Mach which discloses a back massaging device which is used in the nature of a towel. The device includes spaced ribs which provide a massaging or rubbing surface on one side of the device and the other side is smooth. U.S. Pat. No. 2,008,990 granted to Mullen discloses another flexible device which uses a plurality of plugs or pins of differing lengths in three parallel rows to achieve the massaging effect.

However, none of the prior art devices have combined the features of the present invention to produce a safe yet low cost device which works well and which can be used by any person.

SUMMARY OF THE INVENTION

Accordingly, it is an object of the present invention to at least partially overcome these disadvantages by providing a safe yet economical device for massaging the skin.

It is a further object to provide a device which can be made of a material which does not produce untoward or allergic reactions in most cases.

A further object is to produce a device which is suitable for use to massage the skin inside casts, some splints and bandages and the like but which is safe to use, easy to clean and inexpensive to manufacture.

To this end, in one of its aspects, the invention provides a skin massager which comprises a thin, elongated strip having a plurality of randomly-spaced protrusions on one surface and the opposite surface having a plurality of rounded indentations with the remaining areas of the opposite surface being smooth.

In another of its aspects, the invention provides a skin massager for massaging the inside of a cast, splint or the like, said massager comprising a thin, planar elongated strip of a high density, polyethylene plastic material, said strip having a plurality of randomly-spaced protrusions along the length of one surface, the opposite surface having a plurality of rounded indentations therein; one end of said strip being looped to form a handle and the opposite end being rounded.

Further objects and advantages of the invention will appear from the following description taken together with the accompanying drawings.

DESCRIPTION OF THE PREFERRED EMBODIMENT

Figure 1:
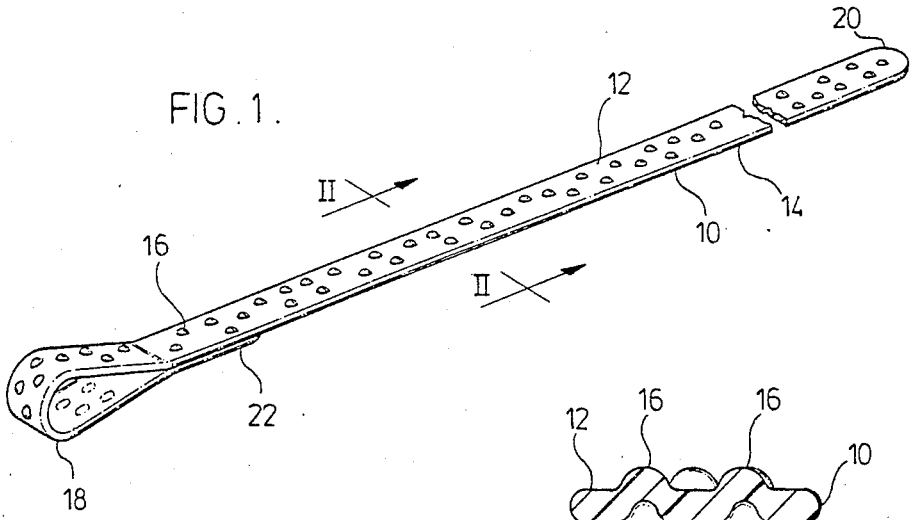
FIG. 1 is a perspective view of a skin massaging device of the present invention.
Figure 2:
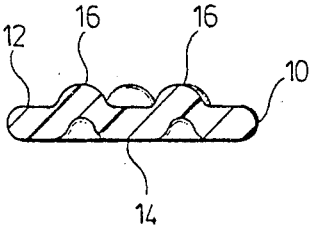
FIG. 2 is a sectional view along line II—II of FIG. 1.

Reference is first made to FIG. 1 which shows a perspective view of the skin massaging device of the present invention.

The device comprises an elongated and thin strip 10 which preferably is made of a plastic material. One surface 12 of the strip 10 carries a plurality of randomly-spaced, outwardly-extending protrusions 16 and the other surface 14 has a plurality of rounded indentations therein, with the remaining areas of the outer surface 14 being smooth.

At one end, the strip 10 is looped to form a handle 18 and the opposite end 20 is rounded, as will be explained hereinafter.

Strip 10 may be made of any suitable material. It has been found that a high density polyethylene is the most suitable material from which to manufacture the strip. It is necessary to avoid using any material which may produce contact sensitization and such materials include mercapto, thiuram, naphthyl or paraphenylenediamine compounds which are used in the manufacture of rubber. Other compounds to be avoided include ethylenediane, formalin, acylic monomers and epoxy resins and hardeners.

One most suitable material is CADCO (trade mark) UHMW which is available from Cadillac Plastic and Chemical Company, a Dayco Company of Birmingham, Mich. This material is an ultra-high molecular weight, polyethylene with molecular weights ranging between 3.1 to 5.67 million. It resembles other polyethylenes in texture, colour, stiffness, weight and general appearance but is much stronger in physical and mechanical strength.

Figure 3:
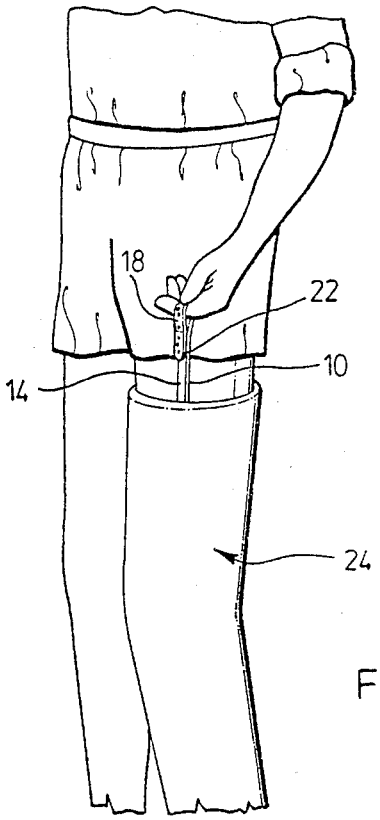
FIG. 3 is a perspective view showing the use of the device of the present invention.

The use of the device will now be explained with reference to FIG. 3 which is shown for illustrative purposes only and is not limiting. The device is designed to relieve normal, occasional skin irritation which occurs within casts or splints. The strip 10 is inserted, as shown in FIG. 3, into the cast 22 with the protrusions 16 (not shown) adjacent to the skin. By repeatedly introducing and withdrawing the device, a gentle massaging action is created. In addition to relieving the itching, this helps to improve blood circulation.

The side 14 of the strip 10 is smooth, that is, it has no protrusions but has a plurality of rounded indentations. These indentations collect and move debris such as loose skin scales, plaster crumbs or dust to the exterior. As this side is adjacent the cast, it will not cause any damage to the cast lining. The other side, having the protrusions 16 thereon, provides a good bumpy massaging surface.

The strip 10 as shown in FIG. 1 is most suitable for use as a skin massager to relieve the itchiness and uncomfortable feeling of the skin which has been enclosed in a cast, splint or the like or if desired, as a skin massager.

The strip is preferably made of a plastic material and most preferably, a high density polyethylene which does not create any allergenic reaction when brought into contact with sensitive or new skin. It is made of a non-allergenic material which is essential to prevent any untoward reaction when brought into contact with the sensitive skin. This material is also quite light in weight and inexpensive.

The strip 10 also has the required flexibility yet sufficient stiffness to work properly. It must be stiff enough to be able to be pushed downwardly inside a cast without curling up but must have sufficient flexibility to be able to turn corners or bend if desired, and to be guided so as to carefully avoid any wound areas.

As the device is used with new and very sensitive skin, it must be and is cleanable. It is preferred to wash the device with alcohol or to merely clean it with soap and water and a nail brush. It is not necessary for the device to be sterilized or sterilizable, although this is preferred.

The device may be sterilized by any manner well known in the art. Suitable examples include the use of a gas sterilizer using ethylene oxide and 10% $CO_2$ at 140° F. for 5 hours or by immersing for 20 to 30 minutes in 70% isopropyl alcohol.

The strip 10 may be made quite inexpensively and thus is a low cost item which is one of its advantages. It may be made by any suitable process. One such process includes cutting the desired shapes from a sheet of plastic then passing each cut strip through a dimpling machine which creates the protrusions 16 and the indentations.

The strip 10 may be of any desired length. However, it has been found that a variety of standard lengths would be sufficient for use with a variety of casts and such lengths are suggested to be 25 cm, 40 cm, 55 cm, 70 cm, 85 cm and 100 cm. In order to produce a finished product of such lengths, it was found to be necessary to cut a strip of material about 10 cm in excess so that sufficient material would be present to form a handle.

The handle 18 may be secured at end 22 by any well known means such as hot plate sealing which involves the application of heat and pressure or for example, by ultrasonic sealing which is the preferred method as this reduces any bubbling or warping which may occur with the hot plate sealing method.

The doubling back of the handle 18 as shown in FIG. 1 is specifically designed to help prevent the strip 10 from being inserted too far into a cast. By doubling the thickness of the strip at the end 22 at the point of securement of the handle, this will create somewhat of a barrier and aid to prevent the strip 10 from being inserted too far into the cast.

Another safety feature of the device is the presence of rounded end 20. This rounded end 20 is preferred to allow the device to be easily inserted to a cast without ripping or damaging the skin and particularly, if there is wound inside the cast.

The device will alleviate the itching and the uncomfortable feeling felt by the wearer of the cast. By inserting and removing the device as shown in FIG. 3, it will also clean and massage the skin inside the cast which promotes healthy growth of new skin cells. It will also tend to clear the skin by catching and removing much of the debris in the indentations themselves. By passing over the skin, the device also helps to massage the skin to promote healthier growth.

It is important to realize that the removal of the debris such as dry skin, dead skin scales etc. from the interior of the cast will also aid in the improvement of the comfort of the user. None of the known massagers effectively combine the massaging aspect with the ability to remove such debris. The present device provides for effective collection and removal of this debris by entrapping such debris in the indentations which is then removed when the massager is removed from the cast. This, when combined with the economical production, the flexibility and safety of the massager, provides distinct advantages over the known massagers.

The following example is given as illustrative only and not limiting.

EXAMPLE 1

A one-half inch wide strip was cut from a thin sheet of high density polyethylene and both sides were levelled to provide a smooth surface having no ridges. Each end of the approximately 15 inch strip was rounded. The strip was run through a dimpling machine which produced protrusions on one side of the strip and rounded indentations on the other side. About three and one-half inches of the strip was turned back to form a small handle and sealed by ultrasonic sealing.

Although the disclosure illustrates and describes a preferred embodiment, it is to be understood that it is not restricted to this embodiment.

What I claim is:

1. A skin massager for massaging the skin covered by a cast, splint or the like, said massager comprising a thin, planar, elongated strip of a high density, hypoallergenic polyethylene material, said strip having dimples along the length thereof, said dimples comprising a plurality of randomly-spaced, rounded protrusions of a first surface of said strip and a plurality of rounded indentations on the opposite and second surface of said strip, the first surface being smooth between said protrusions and the second surface being smooth between said indentations, said material being stiff enough to be pushed between a cast, splint or the like and the skin without curling up and to be quided around normal areas but flexible enough to bend around corners of the cast, splint or the like, one end of said strip being looped to form a handle and the opposite end being rounded.

2. A skin massager as claimed in claim 1 wherein said polyethelene material is an ultra-high molecular weight, polyethylene with molecular weights ranging between 3.1 and 5.67 million.

3. A skin massager as claimed in claim 1 wherein said polyethelene material is sterilizable.

* * * * *